US010354788B2

(12) United States Patent
Bavisetti et al.

(10) Patent No.: US 10,354,788 B2
(45) Date of Patent: Jul. 16, 2019

(54) UNIVERSAL SOLENOID ACTUATOR

(71) Applicant: HONEYWELL INTERNATIONAL INC., Morris Plains, NJ (US)

(72) Inventors: Siva Bavisetti, Bangalore (IN); Deepak Pitambar Mahajan, Bangalore (IN); Vijay Mahesh S, Bangalore (IN); Renukaprasad N, Bangalore (IN); Govind Yadav, Bangalore (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 71 days.

(21) Appl. No.: 15/796,999

(22) Filed: Oct. 30, 2017

(65) Prior Publication Data

US 2019/0131048 A1 May 2, 2019

(51) Int. Cl.
*H01F 7/16* (2006.01)

(52) U.S. Cl.
CPC ... *H01F 7/1607* (2013.01); *H01F 2007/1692* (2013.01)

(58) Field of Classification Search
CPC ..... H01F 7/1607; H01F 2007/1692
See application file for complete search history.

(56) References Cited

U.S. PATENT DOCUMENTS

| | | | |
|---|---|---|---|
| 5,422,617 | A | 6/1995 | Brown |
| 6,791,442 | B1 | 9/2004 | Schmidt |
| 7,876,185 | B2 | 1/2011 | Trinh et al. |
| 9,514,872 | B2 | 12/2016 | Rallabandi et al. |

*Primary Examiner* — Ramon M Barrera
(74) *Attorney, Agent, or Firm* — Lorenz & Kopf, LLP

(57) ABSTRACT

A universal solenoid actuator includes a housing, a flange, a single armature, a first rod, a second rod, a first coil, and a second coil. The housing defines a cavity that is devoid of permanent magnets. The flange comprises a magnetic material and divides the cavity into a first cavity portion and a second cavity portion. The single armature extends through, and is movable within, the armature opening. The first rod and second rods are coupled to opposite ends of the single armature and are moveable therewith. The first and second coils are wound such that: when the first coil is electrically energized, a first force is generated that causes the single armature to move in a first direction, and when the second coil is electrically energized, a second force is generated that causes the single armature to move in a second direction.

20 Claims, 6 Drawing Sheets

UNIVERSAL SOLENOID ACTUATOR

TECHNICAL FIELD

The present invention generally relates to solenoids, and more particularly relates to a universal solenoid actuator that may be used either as a push type or pull type actuator.

BACKGROUND

A solenoid is an electromechanical device that converts electrical energy into mechanical work, and is often used as an actuator to move, for example, valves between two positions. A solenoid is typically configured as either a push-type or a pull-type device, but not both. Moreover, depending upon the application (e.g., either normally-open or normally-closed), the solenoid may need to be redesigned. As may be appreciated, push-type solenoids are not directly replaceable with pull-type solenoids, and vice-versa.

Various other drawbacks are also associated with presently known solenoids. For example, the stroke of a solenoid actuator may vary depending on system requirements. A mechanical latch in a solenoid results in a relatively heavy and bulky design. Solenoid design may vary based on the applied/operating voltage (i.e., DC or AC).

The above drawbacks lead to increased design (and re-design) and manufacturing costs, and lower reliability. Hence, there is a need for one standard solenoid that can be used either as a push-type or a pull-type actuator. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a universal solenoid actuator includes a housing, a flange, a single armature, a first rod, a second rod, a first coil, and a second coil. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first rod is coupled to the single armature and is moveable therewith. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The first coil is disposed within the first cavity portion, and the second coil is disposed within the second cavity portion and is electrically isolated from the first coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

In another embodiment, a universal solenoid actuator includes a housing, a flange, a single armature, a first rod, a second rod, a stroke adjustment mechanism, a first coil, a second coil, a lead wire chimney, and first and second sets of lead wires. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first rod is coupled to the single armature and is moveable therewith. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The stroke adjustment mechanism is coupled to the first rod and is configured to adjustably limit a distance that the single armature can move. The first coil is disposed within the first cavity portion, and the second coil is disposed within the second cavity portion and is electrically isolated from the first coil. The lead wire chimney is coupled to the housing, and the first and second sets of lead wires extend into and through the lead wire chimney and into the housing. The first set of lead wires is connected to the first coil, and the second set of lead wires is connected to the second coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

In yet another embodiment, a universal solenoid actuator includes a housing, a flange, a single armature, a first yoke/return, a second yoke/return, a first interrupter, a second interrupter, a first rod, a second rod, a stroke adjustment mechanism, a first coil, a second coil, a lead wire chimney, and first and second sets of lead wires. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first yoke/return is disposed at least partially within the first cavity portion, and the second yoke/return is disposed at least partially in the second cavity portion. The first interrupter is disposed within the first cavity portion and between the flange and the first yoke/return, and the second interrupter is disposed within the second cavity portion and between the flange and the second yoke/return. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The stroke adjustment mechanism is coupled to the first rod and is configured to adjustably limit a distance that the single armature can move. The first coil is disposed within the first cavity portion, and the second coil is disposed within the second cavity portion and is electrically isolated from the first coil. The lead wire chimney is coupled to the housing, and the first and second sets of lead wires extend into and through the lead wire chimney and into the housing. The first set of lead wires is connected to the first coil, and the second set of lead wires is connected to the second coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

Furthermore, other desirable features and characteristics of the universal solenoid actuator will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention, which is defined by the claims. Furthermore, there is no intention to be constrained by any expressed or implied theory presented in the preceding technical field, background, brief summary, or the following detailed description.

Figure 1:
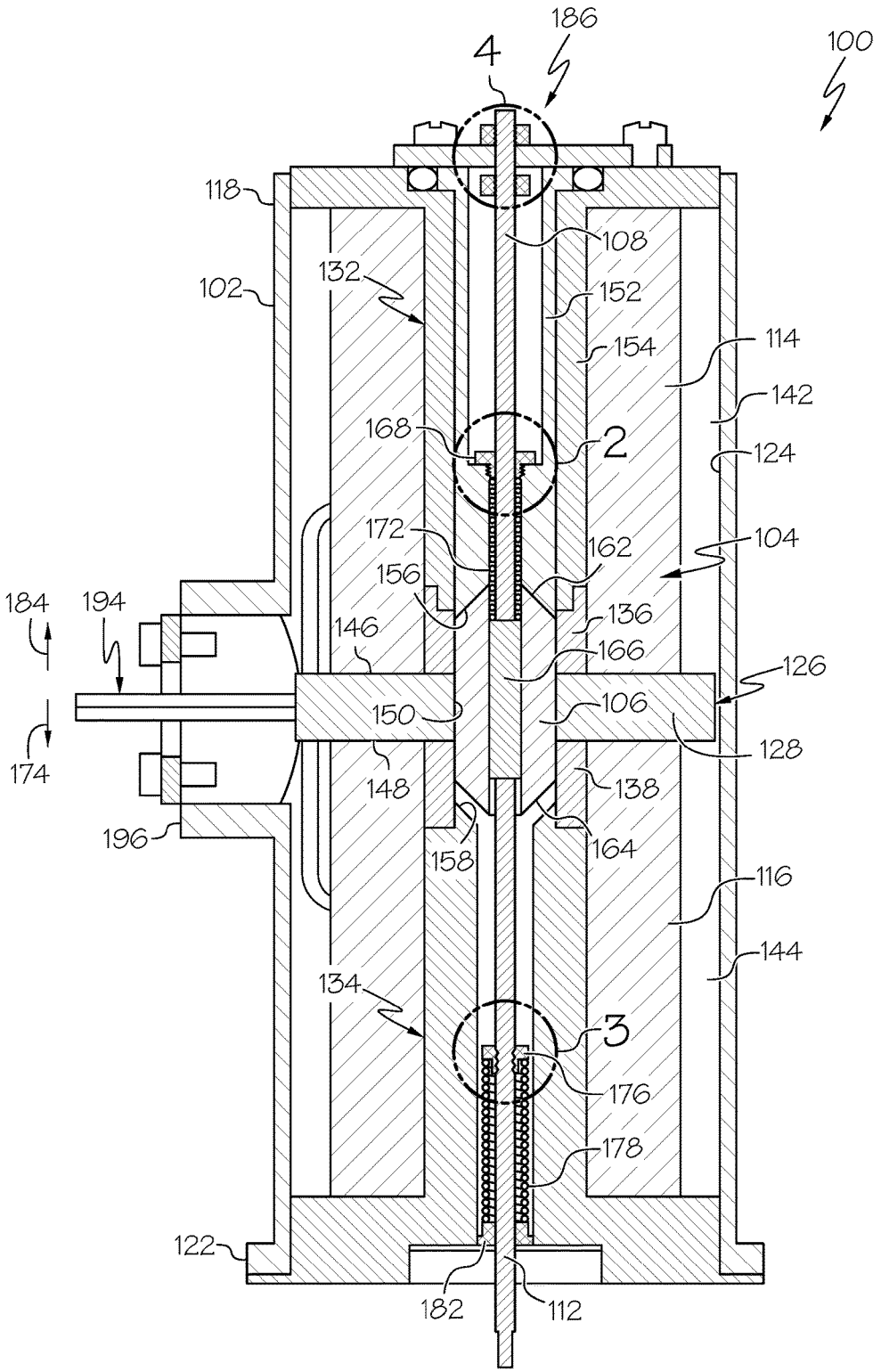
FIG. 1 depicts a cross section view of one embodiment of a universal solenoid actuator.

Referring to FIG. 1, a cross section view of one embodiment of a universal solenoid actuator 100 is depicted, and includes at least a housing 102, a bobbin assembly 104, a single armature 106, a first rod 108, a second rod 112, a first coil 114, and a second coil 116.

The housing 102 is configured to include a first end 118, a second end 122, and an inner surface 124 that defines a cavity 126. Significantly, the cavity 126 is devoid of permanent magnets. Indeed, the actuator 100 includes no permanent magnets whatsoever. The housing 102 may comprise any one of numerous materials having a relatively high magnetic permeability such as, for example, magnetic steel. The housing 102, in addition to having a plurality of components disposed therein, provides a flux path, together with the bobbin assembly 104, for magnetic flux that the first and second coils 114, 116 generate when each is electrically energized.

The bobbin assembly 104 includes at least a flange 128, but in the depicted embodiment additionally includes a first yoke/return 132, a second yoke/return 134, a first interrupter 136, and a second interrupter 138. The flange 128 is fixedly disposed within the housing 102 and divides the cavity 126 into a first cavity portion 142 and a second cavity portion 144. The flange 128 comprises a magnetic material and has a first side 146, a second side 148, and an armature opening 150 that extends between the first 146 and second 148 sides. The first side 146 faces the first cavity portion 142, and the second side 148 faces the second cavity portion 144.

The first yoke/return 132 is coupled to the housing first end 118 on the inside and extends into, and is thus disposed at least partially in, the first cavity portion 142. The second yoke/return 134 is fixedly coupled to the housing second end 122 and extends into, and is thus disposed at least partially in, the second cavity portion 144. The first and second yoke/return sleeves 132, 134 each preferably comprise a material having a relatively high magnetic permeability. It is noted that the first yoke/return 132, at least in the depicted embodiment, comprises two components, an inner yoke/return 152 and an outer sleeve 154. The inner yoke/return 152 and the outer sleeve 154 each preferably comprise a material having a relatively high magnetic permeability.

This configuration is merely exemplary, and in other embodiments the first yoke/return 132 may be implemented as a single piece.

The first yoke/return 132, together with the housing 102, the single armature 106, and the flange 128 provides a magnetic flux path for the magnetic flux that is generated by the first coil 114 when it is energized. The first yoke/return 132 is surrounded by, or at least partially surrounded by, the first coil 114, and includes an armature seating surface 156. The second yoke/return 134, together with the housing 102, the single armature 106, and the flange 128 provides a magnetic flux path for the magnetic flux that is generated by the second coil 116 when it is energized. The second yoke/return 134 is surrounded by, or at least partially surrounded by, the second coil 116, and also includes an armature seating surface 158.

The first interrupter 136 is disposed within the first cavity portion 142, between the flange 128 and the first yoke/return 132. The second interrupter 138 is disposed within the second cavity portion 144, between the flange 128 and the second yoke/return 134. The first interrupter 136 diverts the magnetic flux in the working air gap when the first coils 114 is energized, and the second interrupter 138 diverts the magnetic flux in the working air gap when the second coil 116 is energized. The first and second interrupters 136, 138 may be manufactured from various non-magnetic materials, such as brass or non-magnetic steel (e.g. CRES 302). The first and second interrupters 136, 138 may or may not be permanently joined with the first and second yoke/return(s) 132, 134.

The single armature 106 is disposed within the housing 102 and extends through the armature opening 150. The single armature 106 is axially movable within the armature opening 150 and includes a first end 162 and a second end 164. The first end 162 of the single armature 106 is disposed within the first cavity portion 142, and the second end 164 of the single armature 106 is disposed within the second cavity portion 144. In the depicted embodiment, an armature rod 166 is disposed within the single armature 106. The armature rod 166 is preferably formed of a non-magnetic material and is brazed in place.

Figure 2:
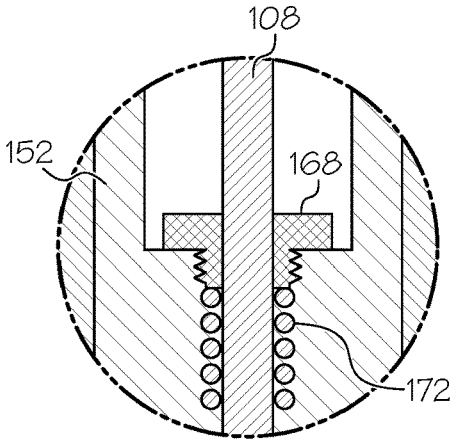
FIGS. 2-4 each depict close-up views of different portions of the universal solenoid actuator of FIG. 1

The first rod 108 is coupled to, and is moveable with, the single armature 106. The first rod 108 extends into the first cavity portion 142 and has a first spring retainer 168 extending radially therefrom. The first spring retainer 168, as may be appreciated, is used for retaining a first spring 172 against the single armature 106. The first spring 172 is disposed within the first cavity portion 142 and surrounds a portion of the first rod 108. The first spring 172 engages the first spring retainer 168 and the single armature 106, and supplies a force to the single armature 106 that urges the single armature 106, and thus the first rod 108 and the second rod 112, to move in a first direction 174. As illustrated more clearly in FIG. 2, which is a close-up view of the first spring retainer 168, in one embodiment the first spring retainer 168 has external threads formed on a portion thereof, which mate with like threads formed on an inner portion of the inner yoke/return 152. This configuration allows the preload on the first spring 172 to be adjusted.

Figure 3:
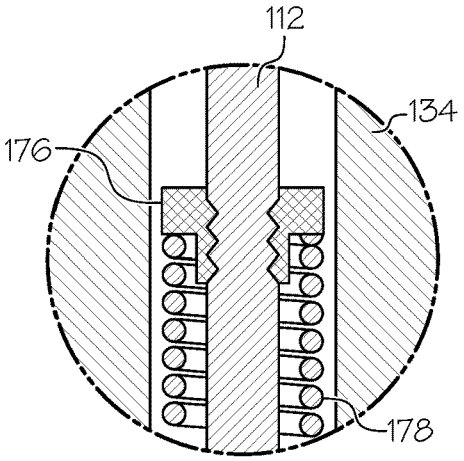

The second rod 112 is also coupled to, and is moveable with, the single armature 106. The second rod 112, however, extends into the second cavity portion 144, and has a second spring retainer 176 extending radially therefrom. A second spring 178 is disposed within the second cavity portion 144 between second spring retainer 176 and rod guide 182 and surrounds a portion of the second rod 112. The second spring 178 engages the second spring retainer 176 and a rod guide 182 that is coupled to, and extends radially from, the second rod 112, and that is spaced apart from the second spring retainer 176. The second spring 178 supplies a force to the second rod 112 that urges the second rod 112, the single armature 106, and the first rod 108, to move in a second direction 184. As illustrated more clearly in FIG. 3, which is a close-up view of the second spring retainer 176, in one embodiment the second spring retainer 176 has internal threads formed on a portion thereof, which mate with like threads formed on an outer portion of the second rod 112. This configuration allows the preload on the second spring 178 to be adjusted.

The first coil 114 is disposed within the first cavity portion 142, and the second coil 116 is disposed within the second cavity portion 144 and is electrically isolated from the first coil 114. The first and second coils 114, 116 are separately coupled to different sets of lead wires 194 that extend into and through a lead wire chimney 196 that is coupled to the housing 102. The first and second coils 114, 116 are wound such that when the first coil 114 is electrically energized, a first force is generated on the single armature 106 that causes the single armature 106 to move in the second direction 184 toward the first cavity portion 142, and thereby cause the first and second rods to move in the second direction 184. The first and second coils 114, 116 are also wound such that when the second coil 116 is electrically energized, a second force is generated on the single armature 106 that causes the single armature 106 to move in the first direction 174 toward the second cavity portion 144 and thereby cause the first and second rods to move in the first direction 174.

Figure 4:
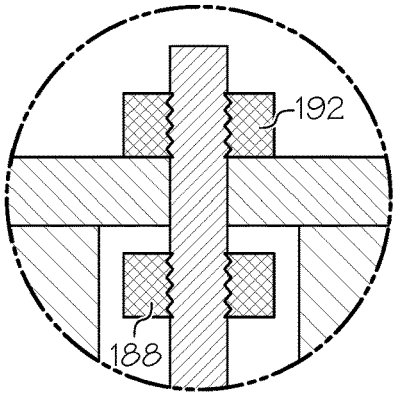

The universal solenoid actuator 100 may also include a stroke adjustment mechanism 186. The stroke adjustment mechanism 186, when included, is coupled to the first rod 108 and is configured to adjustably limit the distance that the single armature 106 can move in the first and second directions 174, 184. Although the stroke adjustment mechanism 186 may be variously implemented, in the depicted embodiment, and as illustrated more clearly in FIG. 4, it includes a pair of adjustable fasteners—a first adjustable fastener 188 and a second adjustable fastener 192—threadedly disposed on the first rod 108. The first adjustable fastener 188 is disposed within the housing 102, and the second adjustable fastener 192 is disposed outside of the housing 102.

Figure 5:
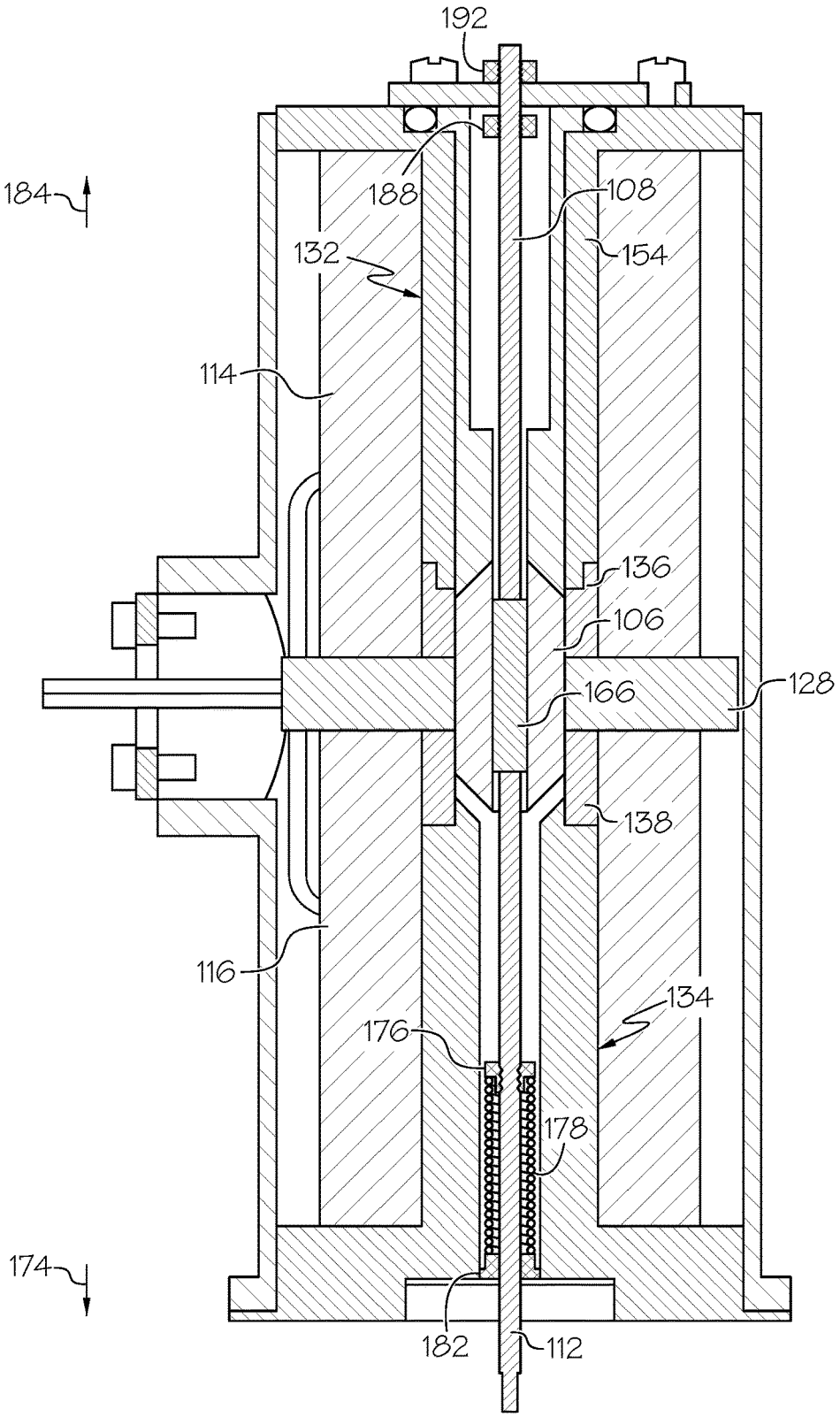
FIG. 5 depicts a cross section view of the universal solenoid actuator of FIG. 1 implemented as a push-type actuator.
Figure 6:
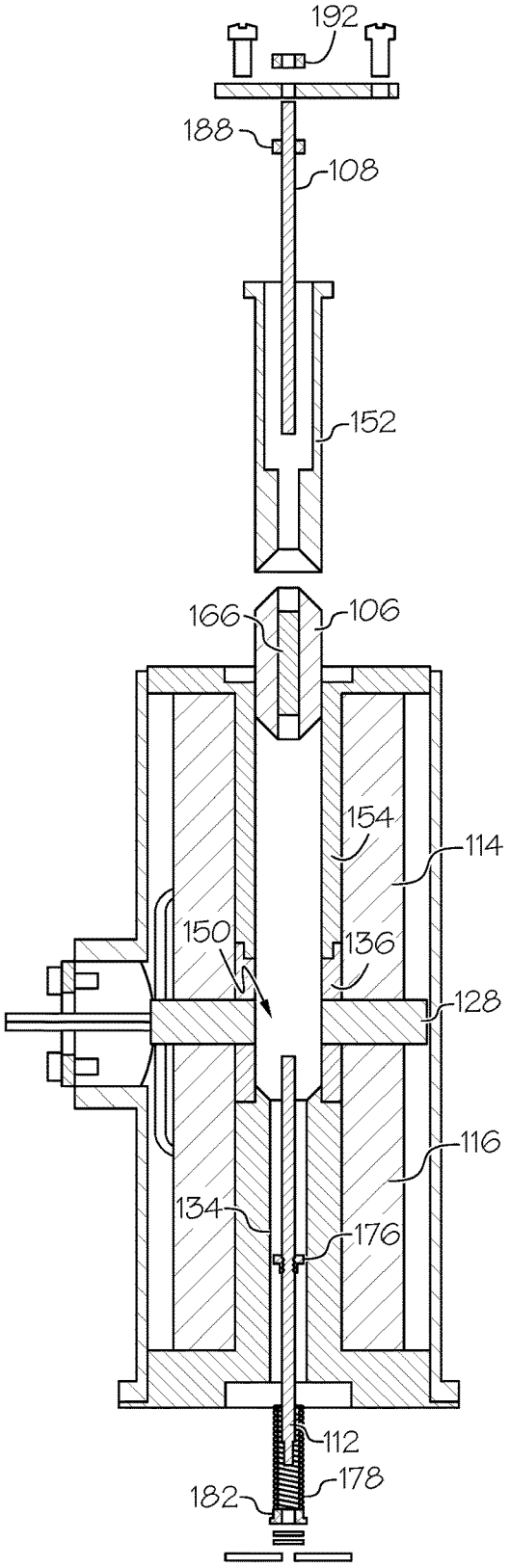
FIG. 6 depicts a partial exploded, cross section view of the universal solenoid actuator of FIG. 1 implemented as a push-type actuator.

The universal solenoid actuator 100 may be implemented as either a push-type solenoid actuator or a pull-type solenoid actuator. A preferred configuration for implementing the universal solenoid actuator 100 as a push-type actuator is depicted in FIGS. 5 and 6. As depicted therein, the first spring 172 may be removed, and the second spring 174 urges the single armature 106 to engage the first yoke/return 132. It will be appreciated that in some embodiments the first spring 172 may remain in place. The universal solenoid actuator 100 is also connected, via the electrical lead wire chimney 196 and appropriate lead wires 194, so that only the second coil 116 is energized. When the second coil 116 is energized, a magnetic flux is generated.

As noted above, the second yoke/return 134, the housing 102, the single armature 106, and the flange 128 provide a path for the magnetic flux, and a force is generated on the single armature 106 that causes it to move in the first direction 174 toward the second cavity portion 144, and thereby causes the first and second rods 108, 112 to also move in the first direction 174. When the second coil 116 is subsequently deenergized, the second spring 178 urges the single armature 106, and thus the first and second rods 108, 112, to move in the second direction 184 toward the first cavity portion 142.

Figure 7:
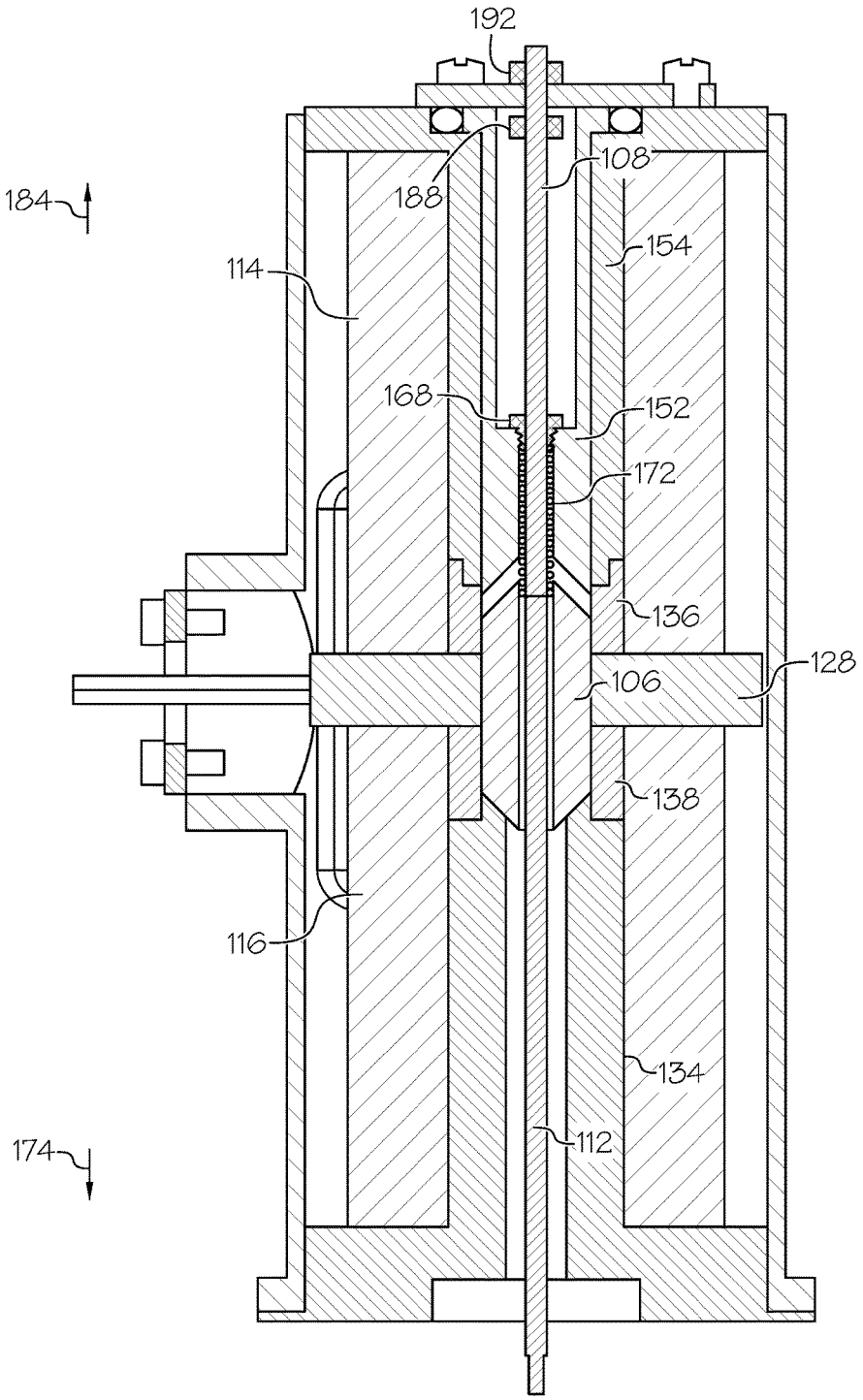
FIG. 7 depicts a cross section view of the universal solenoid actuator of FIG. 1 implemented as a pull-type actuator.
Figure 8:
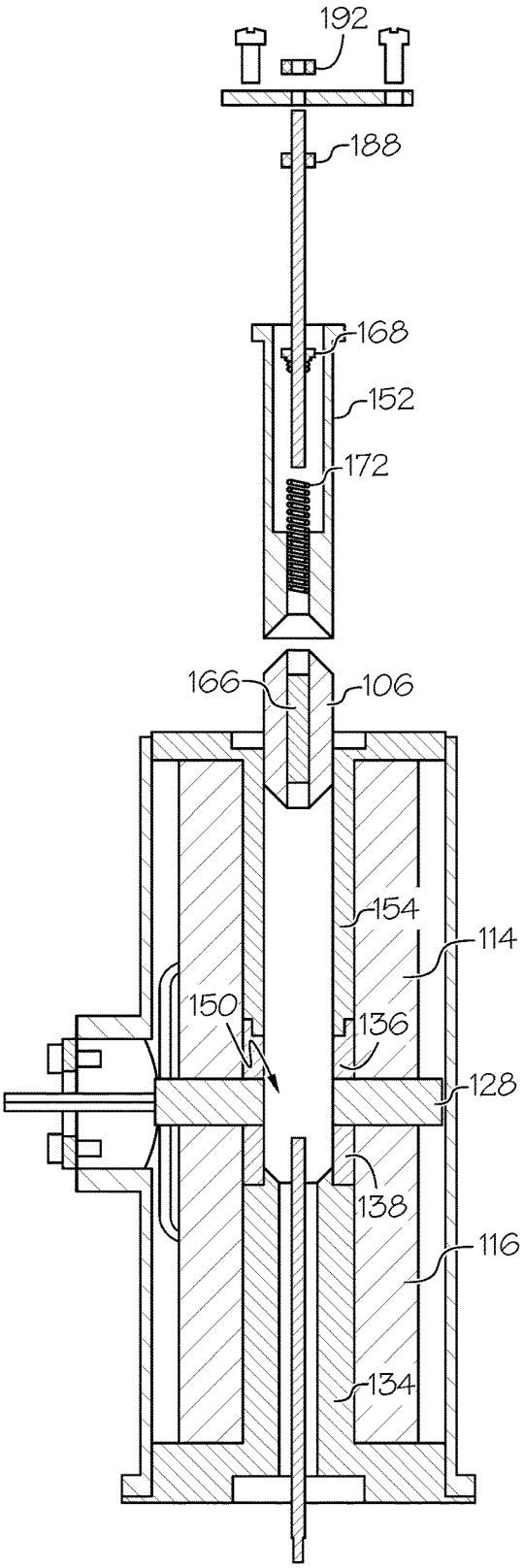
FIG. 8 depicts a partial exploded, cross section view of the universal solenoid actuator of FIG. 1 implemented as a pull-type actuator.

A preferred configuration for implementing the universal solenoid actuator 100 as a pull-type actuator is depicted in FIGS. 7 and 8. As depicted therein, the second spring 178, and thus also the rod guide 182, may be removed. The first spring 172 remains and urges the single armature 106 to engage the second yoke/return 134. It will be appreciated that in some embodiments the second spring 178 (and thus the rod guide 182) may remain in place. The universal solenoid actuator 100 is also connected, via the lead wire chimney 196 and appropriate lead wires 194, so that only the first coil 114 is energized. When the first coil 114 is energized, a magnetic flux is generated. As noted above, the first yoke/return 132, the housing 102, the single armature 106, and the flange 128 provide a path for the magnetic flux, and a force is generated on the single armature 106 that causes it to move in the second direction 184 toward the first cavity portion 142, and thereby causes the first and second rods 108, 112 to also move in the second direction 184. When the first coil 114 is subsequently deenergized, the first spring 172 urges the single armature 106, and thus the first and second rods 108, 112, to move in the first direction 174 toward the second cavity portion 144.

With quick reference to FIG. 6, another configuration of the universal solenoid actuator 100 being implemented as a pull-type actuator is depicted. This embodiment is substantially identical to that of FIG. 5, but the second rod 112 and armature rod 166 are integrally formed.

In one embodiment, a universal solenoid actuator includes a housing, a flange, a single armature, a first rod, a second rod, a first coil, and a second coil. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first rod is coupled to the single armature and is moveable therewith. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The first coil is disposed within the first cavity portion, and the second coil is disposed within the second cavity portion and is electrically isolated from the first coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

These aspects and other embodiments may include one or more of the following features. A first yoke/return may be disposed at least partially within the first cavity portion, and a second yoke/return may be disposed at least partially in the second cavity portion. A first interrupter may be disposed within the first cavity portion and between the flange and the first yoke/return, and a second interrupter may be disposed within the second cavity portion and between the flange and the second yoke/return. The first spring may be disposed within the first cavity and surround a portion of the first rod. The first spring may engage the first spring retainer and the single armature, and supply a force to the single armature that urges the single armature to move in the first direction. The second spring may be disposed within the second cavity and surround a portion of the second rod. The second spring may engage the second spring retainer and the rod guide, and supply a force to the second rod that urges the second rod, and therefore the single armature, to move in the second direction. A stroke adjustment mechanism may be coupled to the first rod and configured to adjustably limit a distance that the single armature can move in the first and second directions. The stroke adjustment mechanism may include a first adjustable fastener that is threadedly disposed on the first rod and disposed within the housing, and a second adjustable fastener that is threadedly disposed on the first rod and disposed outside of the housing. A lead wire chimney may be coupled to the housing, and first and second sets of lead wires may extend into and through the lead wire chimney and into the housing. The first set of lead wires may be connected to the first coil, and the second set of lead wires may be connected to the second coil.

In another embodiment, a universal solenoid actuator includes a housing, a flange, a single armature, a first rod, a second rod, a stroke adjustment mechanism, a first coil, a second coil, a lead wire chimney, and first and second sets of lead wires. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first rod is coupled to the single armature and is moveable therewith. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The stroke adjustment mechanism is coupled to the first rod and is configured to adjustably limit a distance that the single armature can move. The first coil is disposed within the first cavity portion, and the second coil is disposed within the second cavity portion and is electrically isolated from the first coil. The lead wire chimney is coupled to the housing, and the first and second sets of lead wires extend into and through the lead wire chimney and into the housing. The first set of lead wires is connected to the first coil, and the second set of lead wires is connected to the second coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

These aspects and other embodiments may include one or more of the following features. A first yoke/return may be disposed at least partially within the first cavity portion, and a second yoke/return may be disposed at least partially in the second cavity portion. A first interrupter may be disposed within the first cavity portion and between the flange and the first yoke/return, and a second interrupter may be disposed within the second cavity portion and between the flange and the second yoke/return. The first spring may be disposed within the first cavity and surround a portion of the first rod. The first spring may engage the first spring retainer and the single armature, and supply a force to the single armature that urges the single armature to move in the first direction. The second spring may be disposed within the second cavity and surround a portion of the second rod. The second spring may engage the second spring retainer and the rod guide, and supply a force to the second rod that urges the second rod, and therefore the single armature, to move in the second direction.

In yet another embodiment, a universal solenoid actuator includes a housing, a flange, a single armature, a first yoke/return, a second yoke/return, a first interrupter, a second interrupter, a first rod, a second rod, a stroke adjustment mechanism, a first coil, a second coil, a lead wire chimney, and first and second sets of lead wires. The housing has an inner surface that defines a cavity and that is devoid of permanent magnets. The flange is fixedly disposed within the housing and divides the cavity into a first cavity portion and a second cavity portion. The flange comprises a magnetic material and has a first side, a second side, and an armature opening that extends between the first and second sides. The first side faces the first cavity portion, and the second side faces the second cavity portion. The single armature is disposed within the housing and extends through the armature opening. The single armature is axially movable within the armature opening and includes a first end and a second end. The first end is disposed within the first cavity portion, and the second end is disposed within the second cavity portion. The first yoke/return is disposed at least partially within the first cavity portion, and the second yoke/return is disposed at least partially in the second cavity portion. The first interrupter is disposed within the first cavity portion and between the flange and the first yoke/return, and the second interrupter is disposed within the second cavity portion and between the flange and the second yoke/return. The first rod extends into the first cavity portion and has a first spring retainer extending radially therefrom for retaining a first spring against the single armature. The second rod is coupled to the single armature and is moveable therewith. The second rod extends into the second cavity portion and has a second spring retainer extending radially therefrom for retaining a second spring between the second rod and a rod guide that also extends radially from the second rod and is spaced apart from the second spring retainer. The stroke adjustment mechanism is coupled to the first rod and is configured to adjustably limit a distance that the single armature can move. The first coil is disposed within the first cavity portion, and the second coil is disposed within the second cavity portion and is electrically isolated from the first coil. The lead wire chimney is coupled to the housing, and the first and second sets of lead wires extend into and through the lead wire chimney and into the housing. The first set of lead wires is connected to the first coil, and the second set of lead wires is connected to the second coil. The first coil and second coil are wound such that: when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

These aspects and other embodiments may include one or more of the following features. The first spring may be disposed within the first cavity and surround a portion of the first rod. The first spring may engage the first spring retainer and the single armature, and supply a force to the single armature that urges the single armature to move in the first direction. The second spring may be disposed within the second cavity and surround a portion of the second rod. The second spring may engage the second spring retainer and the rod guide, and supply a force to the second rod that urges the second rod, and therefore the single armature, to move in the second direction.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A universal solenoid actuator, comprising:

a housing having an inner surface that defines a cavity and that is devoid of permanent magnets;

a flange fixedly disposed within the housing and dividing the cavity into a first cavity portion and a second cavity portion, the flange comprising a magnetic material and having a first side, a second side, and an armature opening that extends between the first and second sides, the first side facing the first cavity portion, the second side facing the second cavity portion;

a single armature disposed within the housing and extending through the armature opening, the single armature axially movable within the armature opening and including a first end and a second end, the first end disposed within the first cavity portion, the second end disposed within the second cavity portion;

a first rod coupled to the single armature and moveable therewith, the first rod extending into the first cavity portion and having a first spring retainer extending radially therefrom for retaining a first spring against the single armature;

a second rod coupled to the single armature and moveable therewith, the second rod extending into the second cavity portion and having a second spring retainer extending radially therefrom for retaining a second spring between the second rod and a rod guide that also extends radially from the second rod and is spaced apart from the second spring retainer;

a first coil disposed within the first cavity portion; and a second coil disposed within the second cavity portion and electrically isolated from the first coil, wherein the first coil and second coil are wound such that:

when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

2. The universal solenoid actuator of claim 1, further comprising:

a first yoke/return disposed at least partially within the first cavity portion; and a second yoke/return disposed at least partially in the second cavity portion.

3. The universal solenoid actuator of claim 2, further comprising:

a first interrupter disposed within the first cavity portion and between the flange and the first yoke/return; and a second interrupter disposed within the second cavity portion and between the flange and the second yoke/return.

4. The universal solenoid actuator of claim 1, further comprising:

the first spring, the first spring being disposed within the first cavity and surrounding a portion of the first rod, the first spring engaging the first spring retainer and the single armature, the first spring supplying a force to the single armature that urges the single armature to move in the first direction.

5. The universal solenoid actuator of claim 4, further comprising:

the second spring, the second spring being disposed within the second cavity and surrounding a portion of the second rod, the second spring engaging the second spring retainer and the rod guide, the second spring supplying a force to the second rod that urges the second rod, and therefore the single armature, to move in the second direction.

6. The universal solenoid actuator of claim 1, further comprising:

the second spring, the second being disposed within the second cavity and surrounding a portion of the second rod, the second spring engaging the second spring retainer and the rod guide, the first spring supplying a force to the second rod that urges the second rod, and therefore the single armature, to move in the second direction.

7. The universal solenoid actuator of claim 6, further comprising:

the first spring, the first being spring disposed within the first cavity and surrounding a portion of the first rod, the first spring engaging the first spring retainer and the single armature, the first spring supplying a force to the armature rod that urges the first rod to move in the first direction.

8. The universal solenoid actuator of claim 1, further comprising:

a stroke adjustment mechanism coupled to the first rod and configured to adjustably limit a distance that the single armature can move in the first and second directions.

9. The universal solenoid actuator of claim 8, wherein the stroke adjustment mechanism comprises:

a first adjustable fastener threadedly disposed on the first rod and disposed within the housing; and a second adjustable fastener threadedly disposed on the first rod and disposed outside of the housing.

10. The universal solenoid actuator of claim 1, further comprising:

a lead wire chimney coupled to the housing;

first and second sets of lead wires extending into and through the lead wire chimney and into the housing, the first set of lead wires connected to the first coil, the second set of lead wires connected to the second coil.

11. A universal solenoid actuator, comprising:

a housing having an inner surface that defines a cavity and that is devoid of permanent magnets;

a flange fixedly disposed within the housing and dividing the cavity into a first cavity portion and a second cavity portion, the flange comprising a magnetic material and having a first side, a second side, and an armature opening that extends between the first and second sides, the first side facing the first cavity portion, the second side facing the second cavity portion;

a single armature disposed within the housing and extending through the armature opening, the single armature axially movable within the armature opening and including a first end and a second end, the first end disposed within the first cavity portion, the second end disposed within the second cavity portion;

a first rod coupled to the single armature and moveable therewith, the first rod extending into the first cavity portion and having a first spring retainer extending radially therefrom for retaining a first spring against the armature;

a second rod coupled to the single armature and moveable therewith, the second rod extending into the second cavity portion and having a second spring retainer extending radially therefrom for retaining a second spring between the second rod and a rod guide that also extends radially from the second rod and is spaced apart from the second spring retainer;

a stroke adjustment mechanism coupled to the first rod and configured to adjustably limit a distance that the single armature can move;

a first coil disposed within the first cavity portion;

a second coil disposed within the second cavity portion and electrically isolated from the first coil;

a lead wire chimney coupled to the housing; and first and second sets of lead wires extending into and through the lead wire chimney and into the housing, the first set of lead wires connected to the first coil, the second set of lead wires connected to the second coil, wherein the first coil and second coil are wound such that:

when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

12. The universal solenoid actuator of claim 11, further comprising:

a first yoke/return disposed at least partially within the first cavity portion; and a second yoke/return disposed at least partially in the second cavity portion.

13. The universal solenoid actuator of claim 12, further comprising:

a first interrupter disposed within the first cavity portion and between the flange and the first yoke/return; and a second interrupter disposed within the second cavity portion and between the flange and the second yoke/return.

14. The universal solenoid actuator of claim 11, further comprising:

the first spring, the first spring being disposed within the first cavity and surrounding a portion of the first rod, the first spring engaging the spring retainer and the single armature, the first spring supplying a force to the single armature that urges the single armature to move in the first direction.

15. The universal solenoid actuator of claim 14, further comprising:

the second spring, the second spring being disposed within the second cavity and surrounding a portion of the second rod, the second spring engaging the second spring retainer and the rod guide, the second spring supplying a force to the second rod that urges the second rod, and therefore the single armature, to move in the second direction.

16. The universal solenoid actuator of claim 11, further comprising:

the second spring, the second spring being disposed within the second cavity and surrounding a portion of the second rod, the first spring engaging the second spring retainer and the rod guide, the first spring supplying a force to the second rod that urges the second rod, and therefore the single armature, to move in the second direction.

17. The universal solenoid actuator of claim 16, further comprising:

the first spring, the first spring being disposed within the first cavity and surrounding a portion of the first rod, the first spring engaging the first spring retainer and the single armature, the first spring supplying a force to the single armature that urges the single armature to move in the first direction.

18. A universal solenoid actuator, comprising:

a housing having an inner surface that defines a cavity and that is devoid of permanent magnets;

a flange fixedly disposed within the housing and dividing the cavity into a first cavity portion and a second cavity portion, the flange comprising a magnetic material and having a first side, a second side, and an armature opening that extends between the first and second sides, the first side facing the first cavity portion, the second side facing the second cavity portion;

a single armature disposed within the housing and extending through the armature opening, the single armature axially movable within the armature opening and including a first end and a second end, the first end disposed within the first cavity portion, the second end disposed within the second cavity portion;

a first yoke/return disposed at least partially within the first cavity portion;

a second yoke/return disposed at least partially in the second cavity portion;

a first interrupter disposed within the first cavity portion and between the flange and the first yoke/return;

a second interrupter disposed within the second cavity portion and between the flange and the second yoke/return;

a first rod coupled to the single armature and moveable therewith, the first rod extending into the first cavity portion and having a first spring retainer extending radially therefrom for retaining a first spring against the armature;

a second rod coupled to the single armature and moveable therewith, the second rod extending into the second cavity portion and having a second spring retainer extending radially therefrom for retaining a second spring between the second rod and a rod guide that also extends radially from the second rod and is spaced apart from the second spring retainer;

a stroke adjustment mechanism coupled to the first rod and configured to adjustably limit a distance that the single armature can move;

a first coil disposed within the first cavity portion;

a second coil disposed within the second cavity portion and electrically isolated from the first coil a lead wire chimney coupled to the housing; and first and second sets of lead wires extending into and through the lead wire chimney and into the housing, the first set of lead wires connected to the first coil, the second set of lead wires connected to the second coil, wherein the first coil and second coil are wound such that:

when the first coil is electrically energized, a first force is generated on the single armature that causes the single armature to move in a first direction toward the first cavity portion, and thereby cause the first and second rods to move in the first direction, and when the second coil is electrically energized, a second force is generated on the single armature that causes the single armature to move in a second direction toward the second cavity portion, and thereby cause the first and second rods to move in the second direction.

19. The universal solenoid actuator of claim 18, further comprising:

the first spring, the first spring being disposed within the first cavity and surrounding a portion of the first rod, the spring engaging the spring retainer and the single armature, the spring supplying a force to the single armature that urges the single armature to move in the first direction.

20. The universal solenoid actuator of claim 18, further comprising:

the second spring, the second spring being disposed within the second cavity and surrounding a portion of the second rod, the spring engaging the spring retainer and the rod guide, the spring supplying a force to the second rod that urges the second rod, and therefore the single armature, to move in the second direction.

* * * * *